US005987909A

United States Patent [19]

Martin, Sr.

[11] Patent Number: 5,987,909

[45] Date of Patent: Nov. 23, 1999

[54] AIR CONDITIONER DRAIN PAN

[76] Inventor: Lendell Martin, Sr., P.O. Box 40699, Houston, Tex. 77240-0696

[21] Appl. No.: 09/144,023

[22] Filed: Aug. 31, 1998

[51] Int. Cl.[6] ..... F25D 21/14

[52] U.S. Cl. ..... 62/291; 62/288

[58] Field of Search ..... 62/286, 288, 291

[56] References Cited

U.S. PATENT DOCUMENTS

| | | | |
|---|---|---|---|
| 1,846,608 | 2/1932 | Phelps . | |
| 1,860,357 | 5/1932 | Grant . | |
| 2,584,442 | 2/1952 | Frie | 257/137 |
| 3,299,660 | 1/1967 | Sullivan | 62/285 |
| 3,596,475 | 8/1971 | Berger | 62/285 |
| 3,716,097 | 2/1973 | Kelp et al. | 165/39 |
| 4,076,072 | 2/1978 | Bentz | 165/41 |
| 4,088,466 | 5/1978 | Humphrey et al. | 62/286 |
| 4,129,013 | 12/1978 | Hine, Jr. | 62/285 |
| 4,429,734 | 2/1984 | Vandervaart | 165/144 |
| 4,474,232 | 10/1984 | Wright et al. | 165/137 |
| 4,542,786 | 9/1985 | Anders | 165/144 |
| 4,671,076 | 6/1987 | Duren | 62/289 |
| 4,698,982 | 10/1987 | Laios et al. | 62/286 |
| 5,121,613 | 6/1992 | Cox et al. | 62/419 |
| 5,143,178 | 9/1992 | Latham, Jr. | 184/106 |
| 5,195,332 | 3/1993 | Sullivan | 62/291 |
| 5,199,276 | 4/1993 | Sullivan | 62/291 |
| 5,207,074 | 5/1993 | Cox et al. | 62/285 |
| 5,284,027 | 2/1994 | Martin, Sr. | 62/291 |
| 5,347,980 | 9/1994 | Shellenberger | 126/110 |
| 5,664,431 | 9/1997 | Martin, Sr. | 62/286 |
| 5,715,697 | 2/1998 | Rust, Jr. et al. | 62/286 |
| 5,904,053 | 5/1999 | Polk et al. | 62/285 |

FOREIGN PATENT DOCUMENTS

| | | |
|---|---|---|
| 58-18094 | 2/1983 | Japan . |
| 58-35343 | 2/1983 | Japan . |

OTHER PUBLICATIONS

A Coil of Quality, ASM Series Low Profile Vertical Coils, All Style Coil Co., Inc., 1994.

A Coil of Quality, Evaporator Coils For All Styles of Air Conditioning Equipment, Allstyle Coil Co., Inc., 1994.

Payne Model 519E, Form No. PDS 519E 18.4P, Payne Air Conditioning, 1990.

M Series Vertical Evaporator Coils, Allstyle Coil Co., Inc., 1996.

ASFM Series: Horizontal Evaporator Coil, Allstyle Coil Co., 1991.

*Primary Examiner*—Henry Bennett
*Assistant Examiner*—Melvin Jones
*Attorney, Agent, or Firm*—Guy McClung

[57] ABSTRACT

A multi-pan for an air conditioning system which has a coil positionable in one of three orientations has been invented, the multi-pan includes, in certain aspects, a bottom pan having walls defining an inner space the bottom pan disposed for receiving water from the coil when the coil is positioned above the bottom pan, a first side pan connected at one end to the bottom pan, the first side pan disposed for receiving water from the coil when the coil is positioned above the first side pan, and a second side pan connected at one end to the bottom pan and spaced apart from the first side pan by the bottom pan, the second side pan disposed for receiving water from the coil when the coil is positioned above the second side pan. the bottom pan can be configured for an A (or V) coil with an air flow space therethrough, or for an M-coil with two air flow spaces therethrough and a middle pan part.

24 Claims, 8 Drawing Sheets

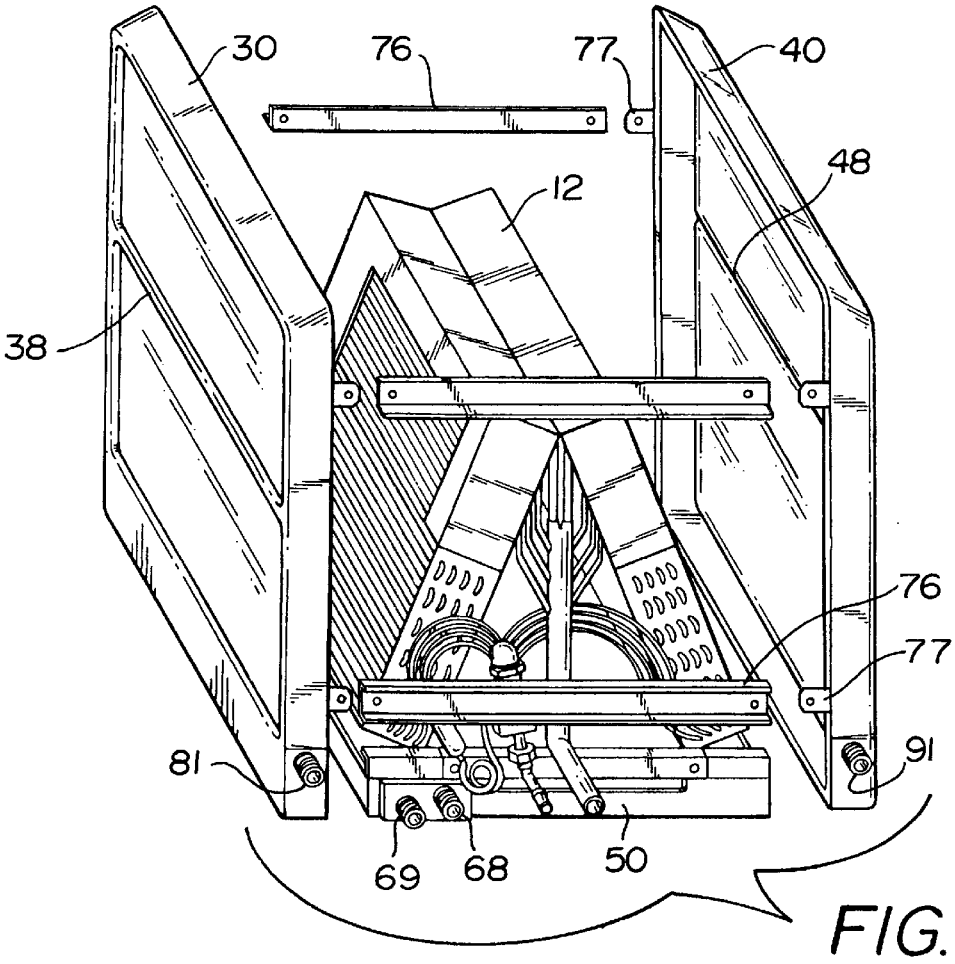
FIG. 2
FIG. 3
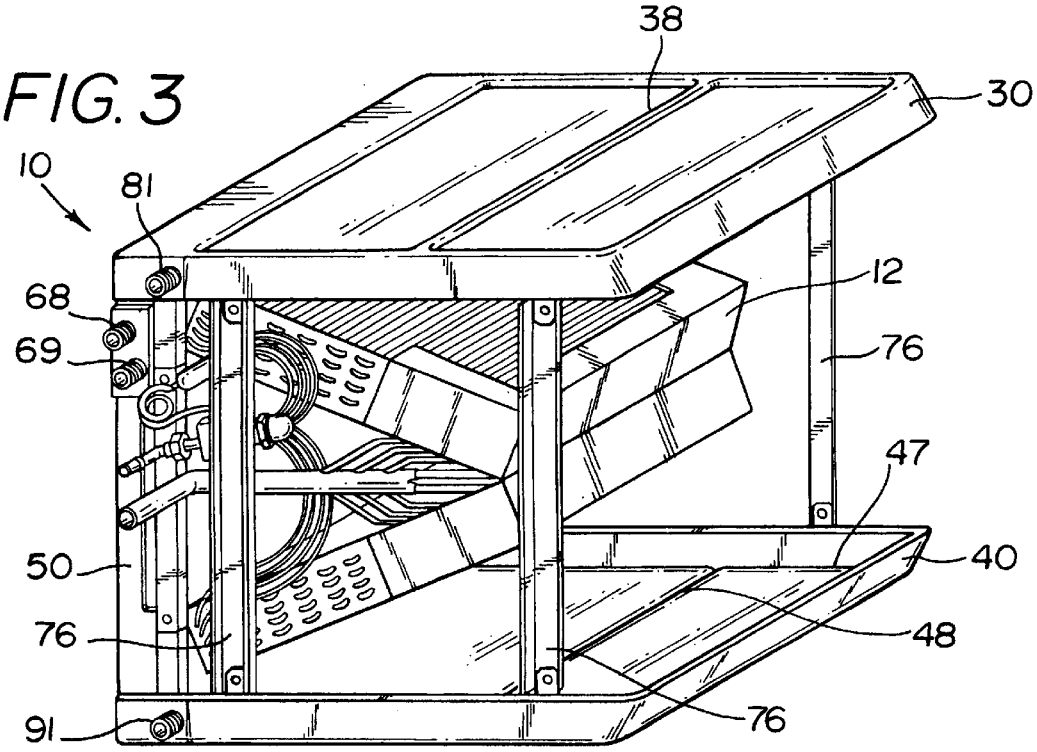

FIG. 6A
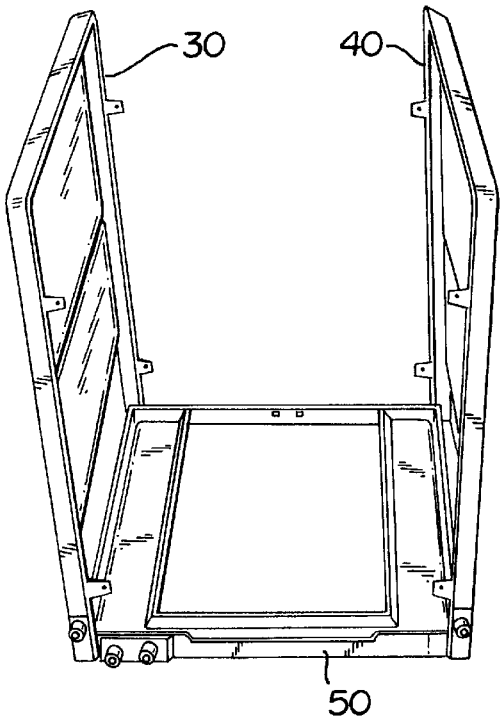
FIG. 6B
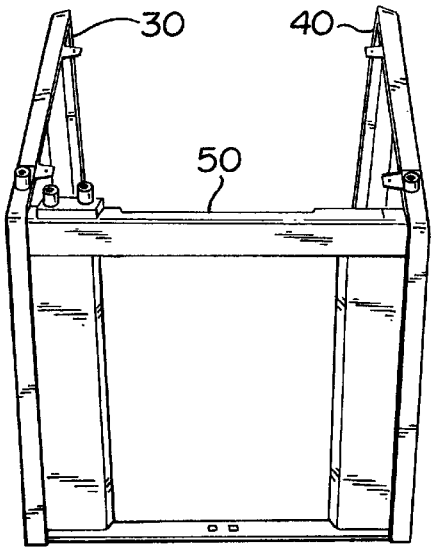
FIG. 6C
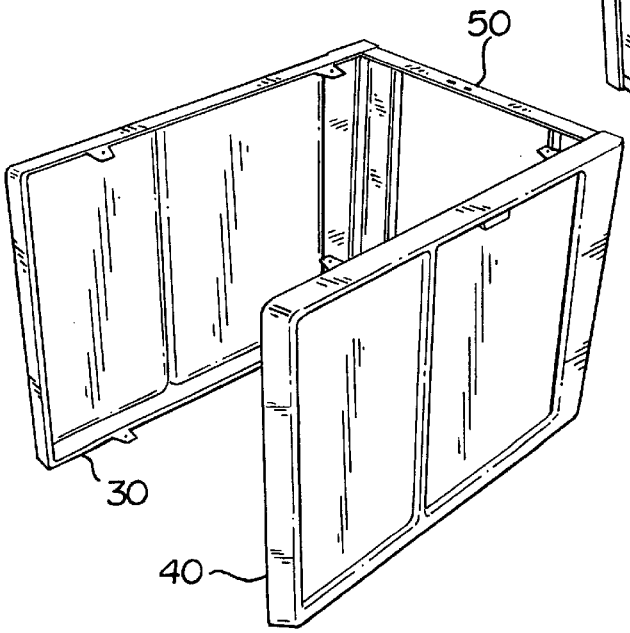
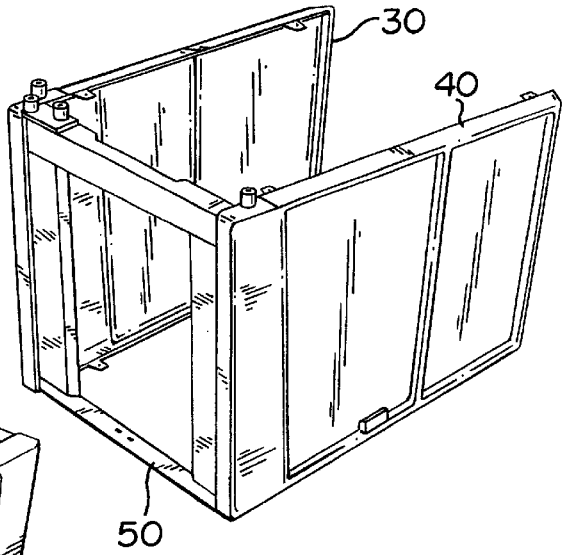
FIG. 6D

AIR CONDITIONER DRAIN PAN

BACKGROUND OF THE INVENTION

1. Field of the Invention

This invention is directed to drain pans for air conditioning systems and in one aspect, to such systems including a coil.

2. Description of Related Art

In many prior art air conditioning systems a coil in a housing is oriented in a particular direction depending on the coil design, housing design, and available drain pans. In certain systems, a V-shaped coil (sometimes called an "A" coil) or M-shaped coil (when coils are viewed from one end) is used with the V or M pointing up. Alternatively these coils are positioned with the coil on a side.

Often it is desirable to re-orient a coil which is already positioned in a housing with the V (or A) pointing up or with the V (or A) or M pointing horizontally. After re-positioning there must be a pan beneath the coil.

There has long been a need for a drain pan suitable for triple coil positions. There has long been a need for such an apparatus which is simple, easily made, easily installed, and easily accessed.

SUMMARY OF THE PRESENT INVENTION

The present invention discloses, in one embodiment, a drain pan system for an air conditioning system with a coil.

The present invention, in certain embodiments, discloses a multi-pan for an air conditioning system which has an optional coil positionable in one of at least three orientations, the multi-pan includes a bottom pan having walls defining an inner space with the bottom pan disposed for receiving water from the coil when the coil is positioned above the bottom pan; a first side pan connected at one end to the bottom pan, the first side pan disposed for receiving water from the coil when the coil is positioned above the first side pan; and a second side pan connected at one end to the bottom pan and spaced apart from the first side pan by the bottom pan, the second side pan disposed for receiving water from the coil when the coil is positioned above the second side pan. The side pans may be at any desired angle to the bottom pan.

In one aspect each pan part of a multi-pan according to the present invention is a single integral plastic piece and the three pieces may be held together with a friction fit, with an appropriate adhesive, with fasteners, and/or with cross bracing. Also brace(s) may be used between the pan pieces and a coil. Pan members may have raised one or more portions with a groove or grooves on a side and/or through a raised portion thereof to facilitate fluid flow to a pan end trough. The end trough may be at a level of the grooves—which is a level lower than the level of the raised portions.

Such a multi-pan may be used with any suitable coil, including, but not limited to, an M-coil, A-coil, or a V-coil ("M," "A," and "V" referring to a general shape of a coil when viewed on end).

Any pan and/or pan parts of a system according to the present invention may be of any desired and suitable dimensions and configuration to accommodate a particular coil and/or housing, as may be any of a system's pan openings, walls, grooves and/or drain outlets, and any suitable plastic or metal may be used for the pan and its components. Other than a drain hole and outlet fitting for each sub-pan, side pan or bottom pan, any known system and/or apparatus for removing fluid may be used, including, but not limited to, a pump system or siphon.

What follows are some of, but not all, the objects of this invention. Objects other than the specific objects stated below, additional objects and purposes will be readily apparent to one of skill in this art who has the benefit of this invention's teachings and disclosures. It is, therefore, an object of at least certain preferred embodiments of the present invention to provide new, useful, unique, efficient and nonobvious drain pan apparatus for air conditioning systems, and systems with such pan apparatus;

An additional object of the present invention is the provision of such apparatuses which can accommodate a variety of different configurations of air conditioning systems;

A further object of the present invention is the provision of drain pan with three pans, so that a coil can be oriented in one of three possible orientations—vertically or to either side;

Yet another object of the present invention is the provision of a system in which a coil, e.g. an A-coil, V-coil or M-coil installed in a housing may be positioned vertically or on either side without having to remove the coil from the housing;

Another object of the present invention is the provision of such a drain pan and system useful in already existing housings and spaces; and An additional object of the present invention is the provision of a drain pan with an opening or openings therethrough so that air may flow through the opening or openings to a coil mounted on or above the pan; thus, permitting a coil on such a pan to be used in either a vertical flow or a horizontal flow system; and a pan-coil combination using such a pan.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 2 is an exploded front perspective view of the system of FIG. 1.

FIG. 3 is a front perspective view of the system of FIG. 1 with the system turned on one side.

FIGS. 6A–6D are perspective views of the pan of FIG. 1.

DESCRIPTION OF EMBODIMENTS PREFERRED AT THE TIME OF FILING FOR THIS PATENT

Figure 1:
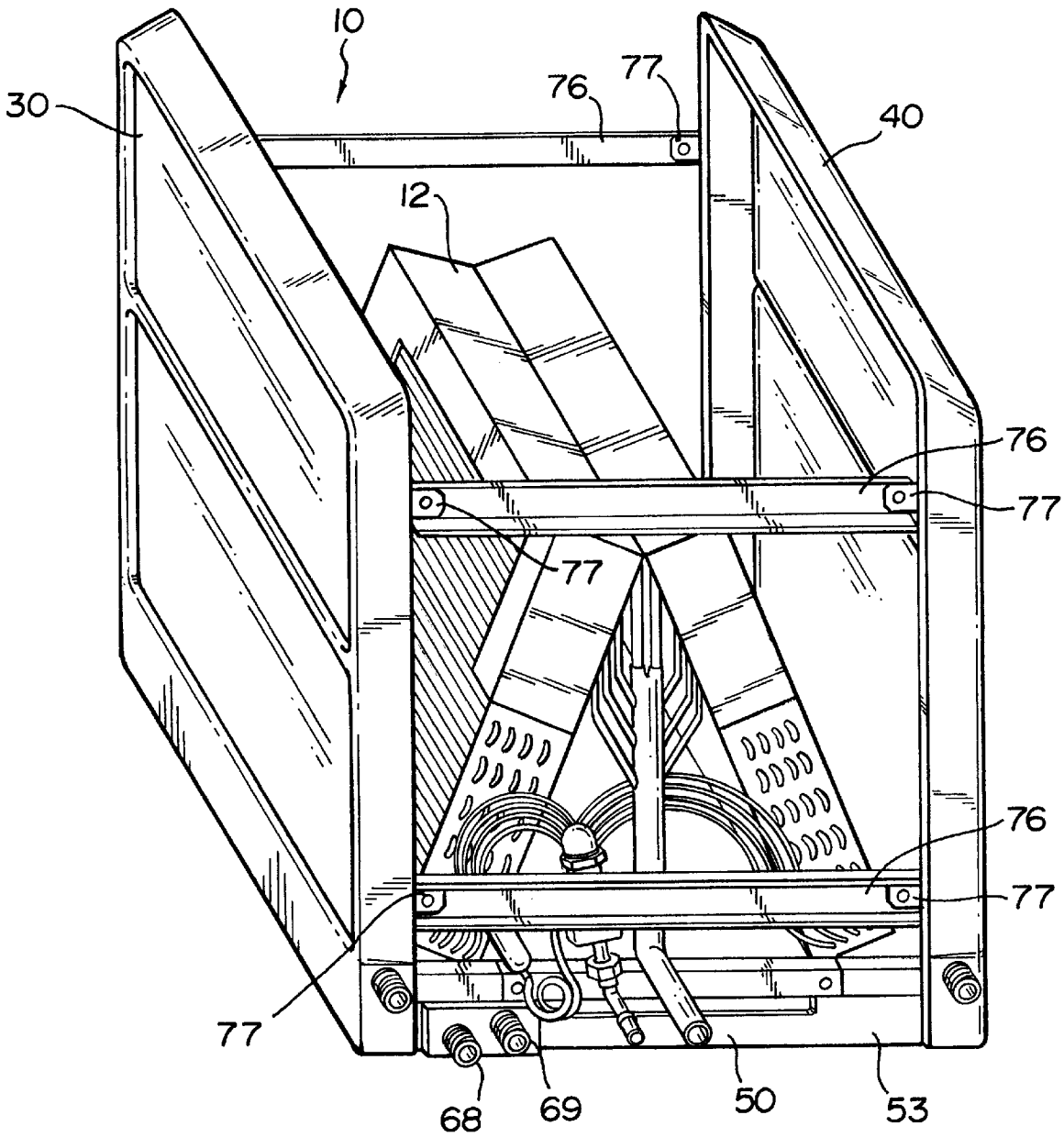
FIG. 1 is a front perspective view of a pan and coil system according to the present invention.

FIG. 1 shows an air condition coil and pan system 10 according to the present invention that has a pan member 20 and a coil 12. The pan member 20 has two side pans 30 and 40 and a bottom pan 50.

Figure 4:
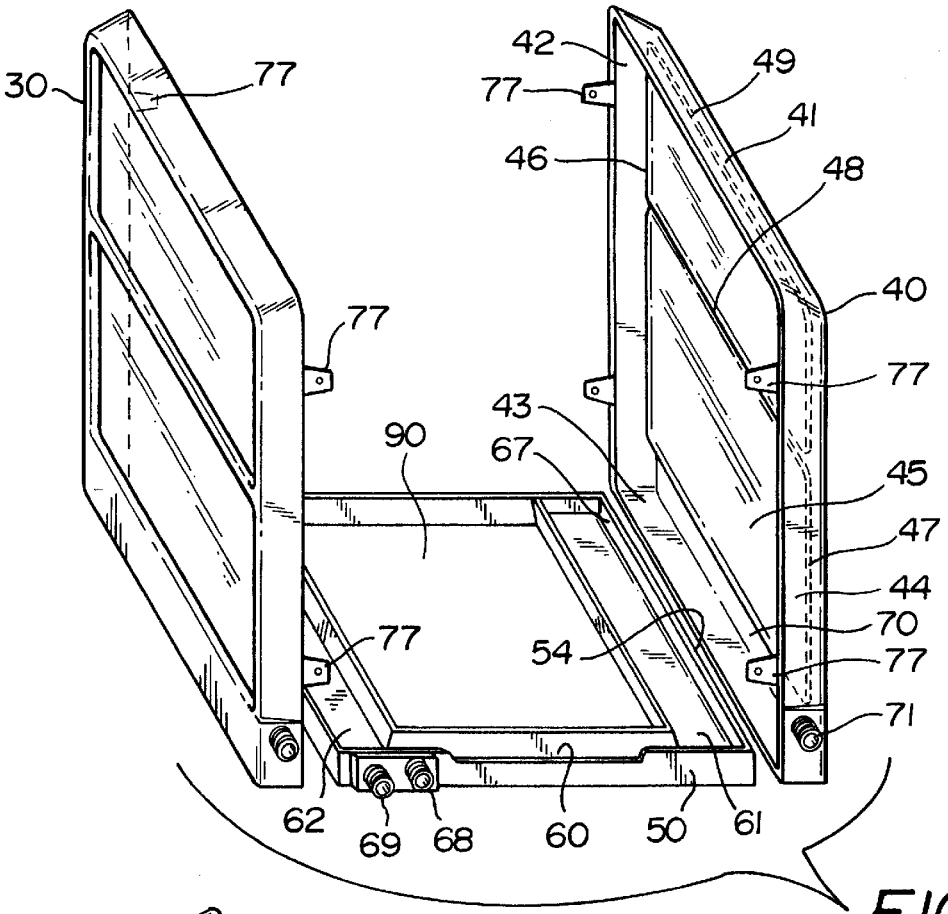
FIG. 4 is an exploded perspective view of the pan of FIG. 1.
Figure 5:
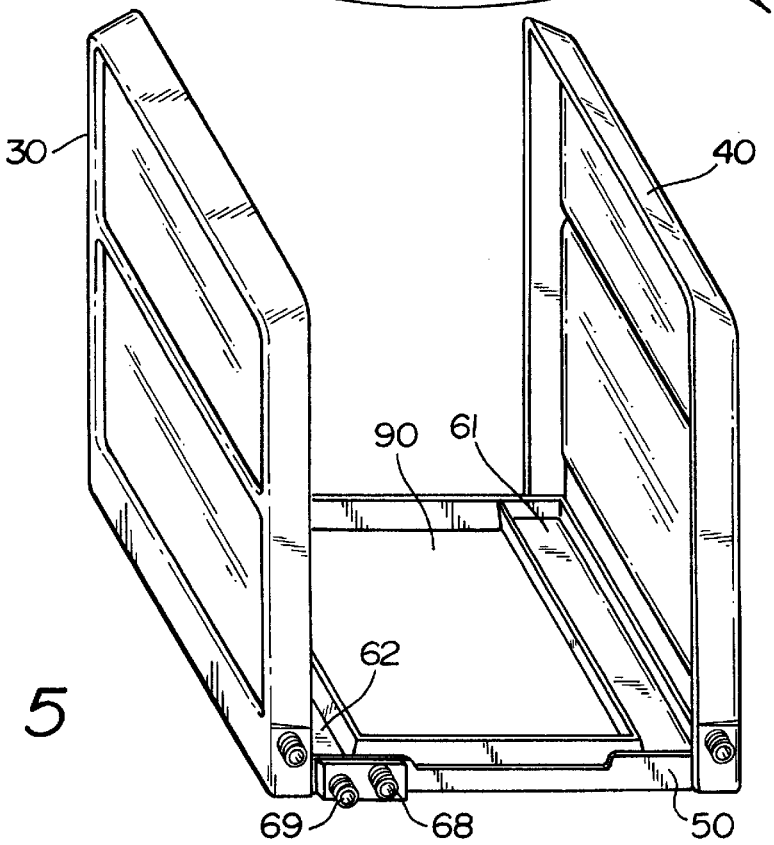
FIG. 5 is a perspective view of the pan of FIG. 1.
Figure 7A:
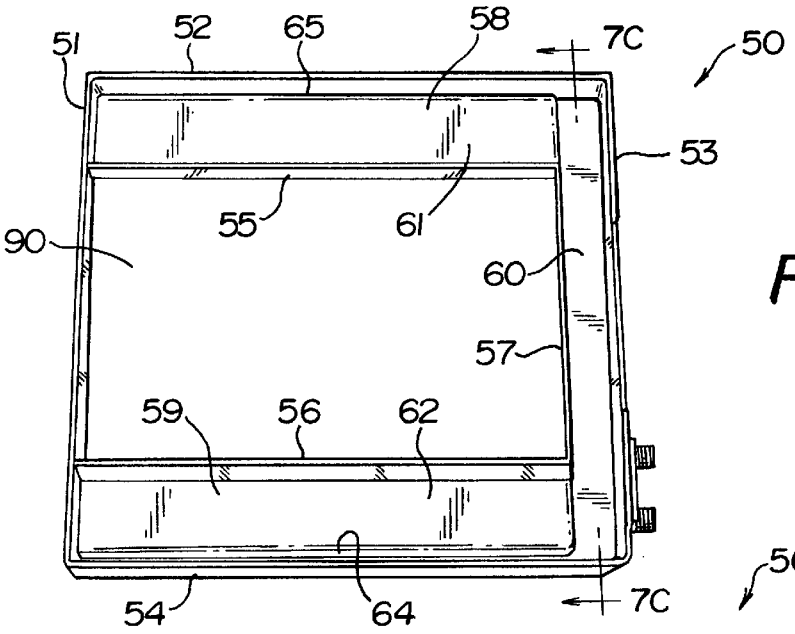
FIG. 7A is a top view of the bottom pan of FIG. 1.
Figure 7B:
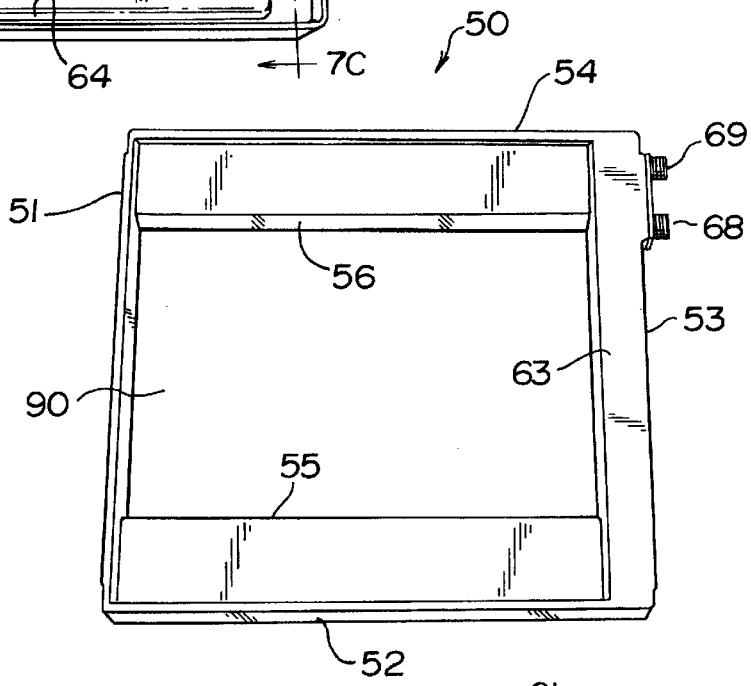
FIG. 7B is a bottom view of the pan of FIG. 1.

As shown in FIGS. 1, 4 and 7A, the bottom pan 50 has four outer sides 51, 52, 53, and 54 and three inner sides 55, 56, and 57. The sides 52, 55, a bottom wall 61 and a portion of the side 51 define a side sub-pan 58 which has an open end from which collected water from a coil flows into an end trough 60. The end trough 60 is defined by the side 57, the side 53, and a bottom wall 63. Sides 54, 56, a portion of side 51, and a bottom wall 62 define a sub-pan 59. The end trough 60 is at a level lower than that of a level of the bottom walls 61, 62.

Figure 7C:
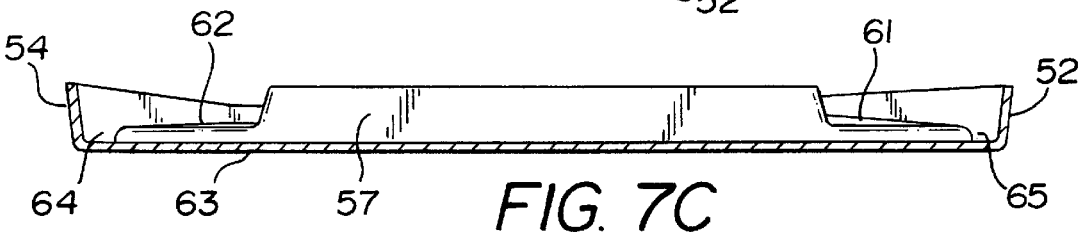
FIG. 7C is a view along line 7C—7C of FIG. 7A.
Figure 7D:
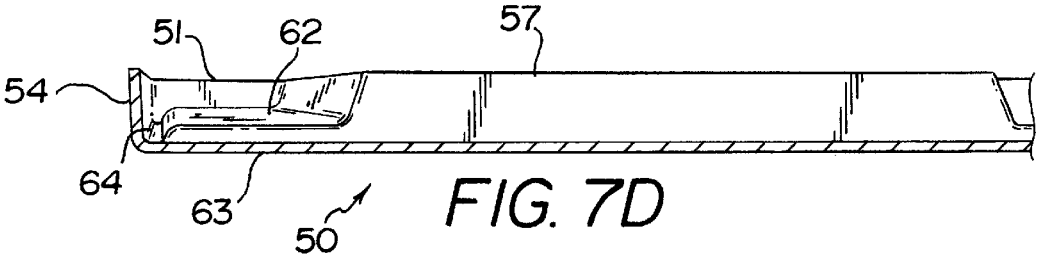
FIG. 7D shows part of the cross-section view of FIG. 7C.
Figure 8A:
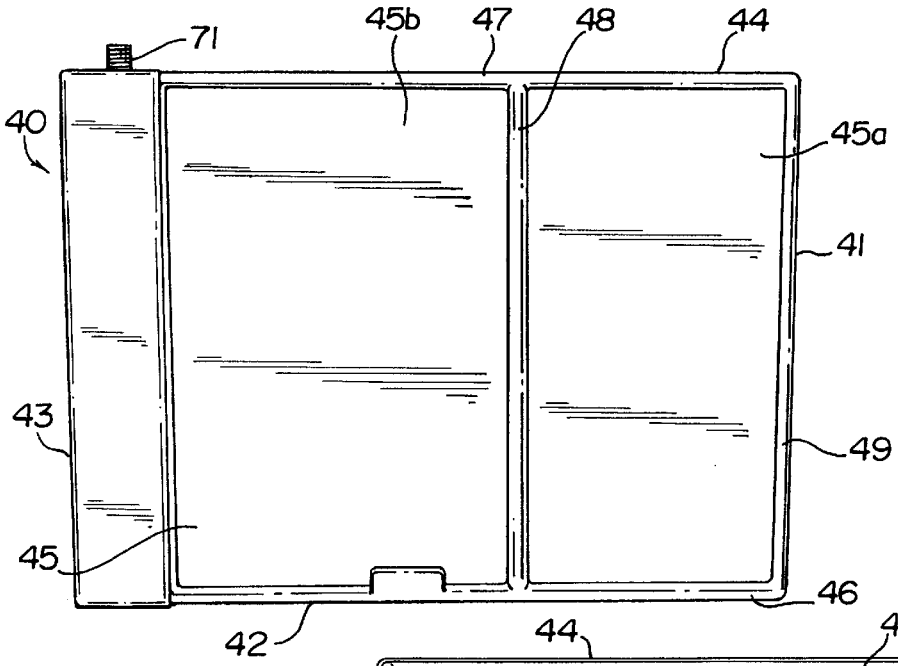
FIG. 8A is a bottom view of a side pan of FIG. 1.
Figure 8B:
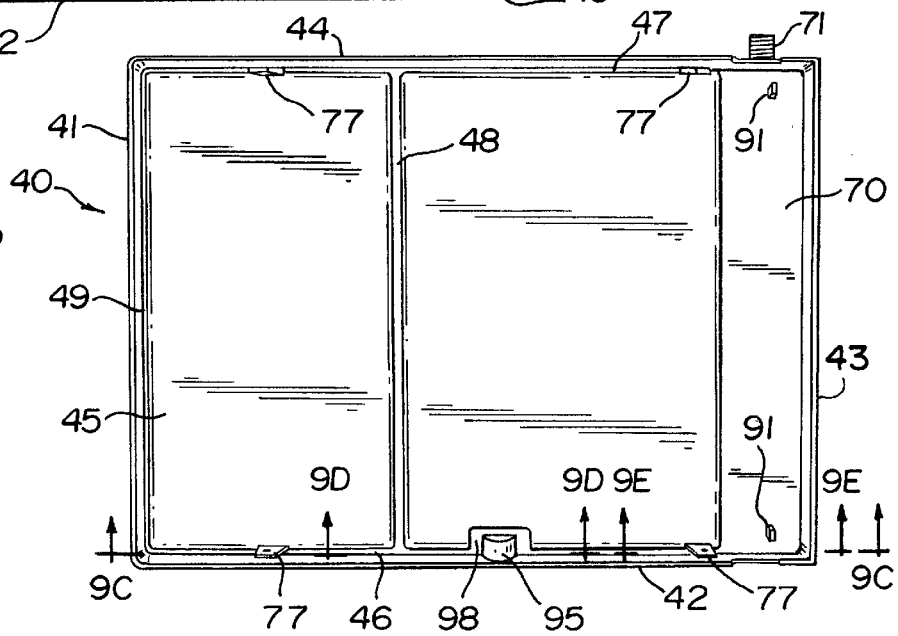
FIG. 8B is a top view of the side pan of FIG. 8A.
Figure 8C:
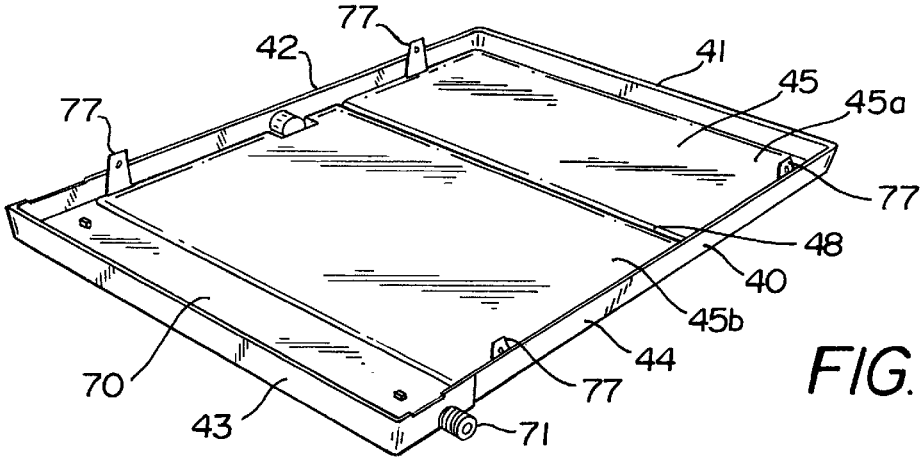
FIG. 8C is a perspective view of the side pan of FIG. 8A.

As shown in FIG. 7C, the bottom walls 61 and 62 are at a level above the bottom wall 63. A recess 64 is disposed between the wall 67 and the side wall 54. The bottom wall 61 and the side wall 54 and a recess 65 is disposed between a wall 66 and the side wall 52. The recesses 64, 65 are, in this preferred embodiment, at the same level as the bottom wall 63 of the end trough 60. This facilitates flow from the side pans 58 and 59 into the end trough 60. It is within the scope of this invention to have the recesses 64, 65 ramped down from the wall 51 to the end trough 60 and to have two or more such recesses in the bottom walls 61, 62.

A central opening 90 in the bottom pan 50 provides an area for air flow to the coil 12 (e.g. an A or V coil). Two outlet fittings 68, 69 are provided through the wall 53 from which water can drain from the pan member 50.

FIGS. 1, 4, and 8A–8C, inter alia, show the side pan 40 which has four side walls 41, 42, 43 and 44 and a bottom wall 45. The side pan 40 is generally rectangular in shape. The bottom wall 45 has recesses 46 and 47 on each of two sides of the pan 40 and a recess 48 interconnecting the two recesses 46, 47. A recess 49 at one end of the pan 40 communicates with the side recesses 46, 47. The recesses 46, 47, 48 and 49 are at the same level as an end trough 70 and the recesses facilitate flow from the bottom wall 45 to the end trough 70. The recess 48 divides the bottom wall 45 into two portions or "tables" 45*a* and 45*b*.

An outlet fitting 71 provided through the wall 44 provides a drain from the end trough 70.

The width of the pan 40 between the inner surfaces of the walls 41, 43 is sized for a tight friction fit with the pan 50 received therebetween. In another embodiment the pan 40 is sized to sealingly fit into an end of the pan 50. It is within the scope of this invention to glue the pans 40, 50 together and/or to clamp or screw them together. Tabs 91 (see FIG. 8B) facilitate correct emplacement of the pan 50 in the pan 40 and also hold the pan 50 in place. Tabs 92 may be used as securement points for braces or brackets.

Figure 9A:
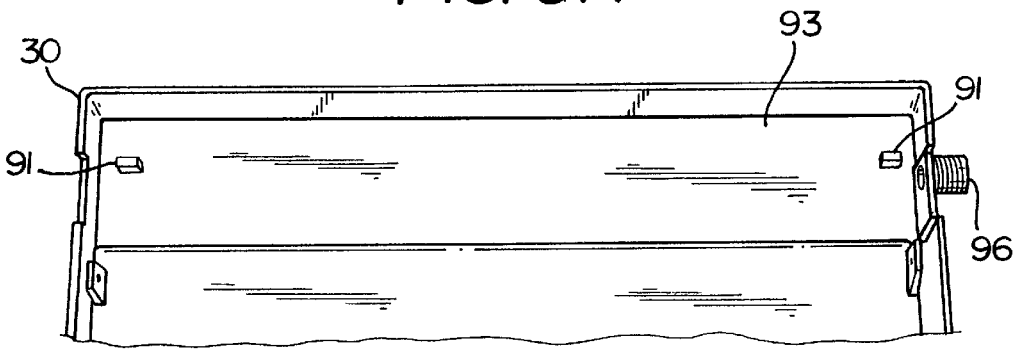
FIG. 9A is a top view of part of a side pan of the pan of FIG. 1.
Figure 9B:
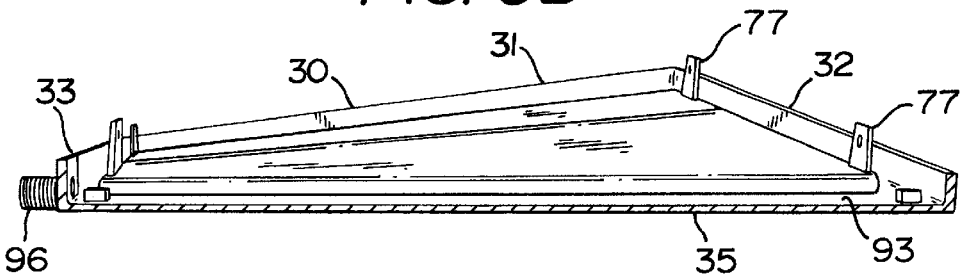
FIG. 9B is a view along line 9B—9B of FIG. 8B.
Figure 9C:
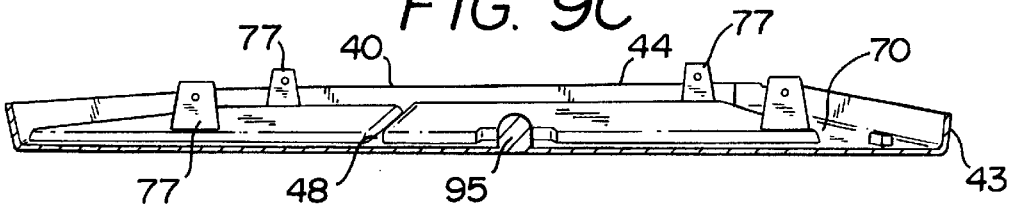
FIG. 9C is a along line 9C—9C of FIG. 8B.
Figure 9D:
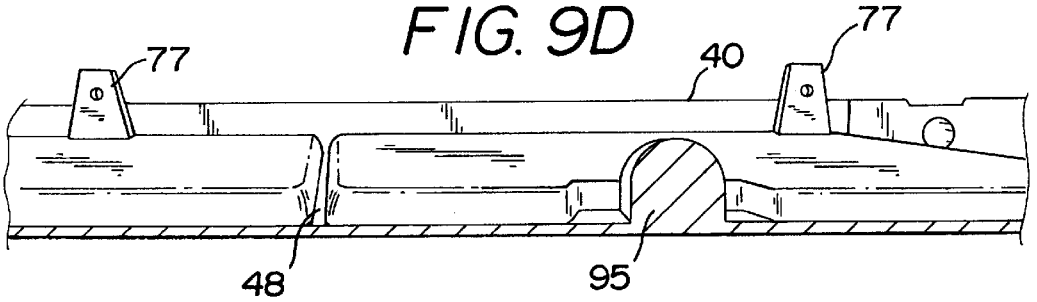
FIG. 9D is an enlarged view of part of the pan of FIG. 9C.
Figure 9E:
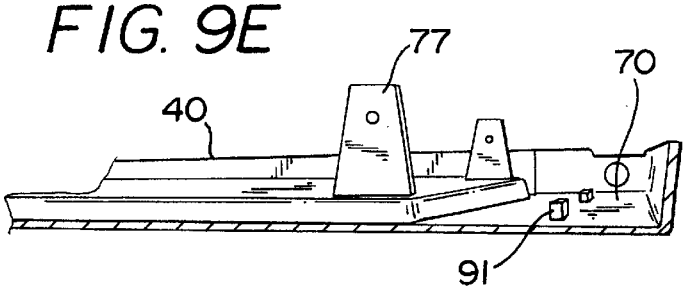
FIG. 9E is an enlarged view along of part of the pan of FIG. 9C.
Figure 9F:
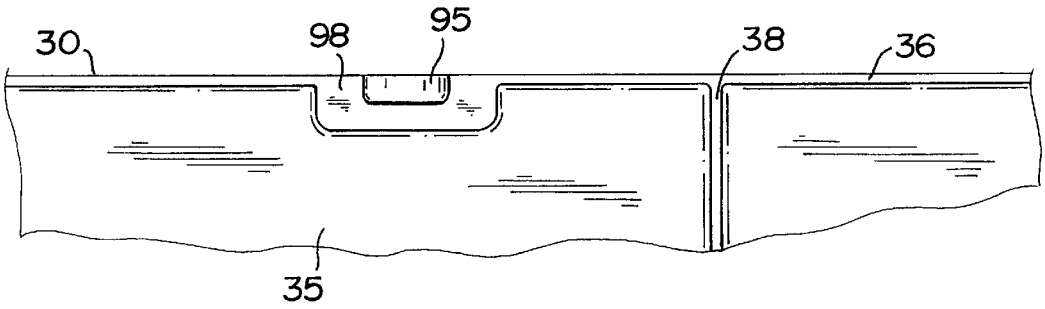
FIG. 9F is a top view of part of the pan of FIG. 9D.

The pan 30 (e.g. as in FIGS. 1, 4, and 9A, inter alia) is a mirror image of the pan 40 and mates with the pan 50 in the same way. The pan 30 has sides 31, 32, 33, 34 and a bottom wall 35; recesses 36, 37, 38 and 39; end trough 93; and outlet fitting 96. Hump 95 with groove 98 therearound can serve as a drain mount.

In one aspect each of the pans 30, 40, 50 is an integral molded piece made, in certain embodiments from plastic; e.g. but not limited to polystyrene, nylon, polycarbonate and polyethylene.

The pan 50 has its side pans 58, 59 positioned so that a V-coil as the coil 12, FIG. 1, sits above the pan 50 with each of its bases over one of the side pans 58, 59. Thus in a configuration in which the V-coil is positioned as in FIG. 1, water drains from the coil into the side pans 58, 59.

As shown in FIG. 3, when the coil 12 is positioned on one side, water condensing on and dripping from the coil 12 flows into the pan 40. If the coil 12 was positioned to the other side, the pan 30 would be beneath the coil 12 and water from the coil could fall into the pan 30. In each position (FIG. 1, FIG. 3, or to the other side from that of FIG. 3) a drain outlet is provided (outlet 68, 69, 81, or 91) for water flowing from whichever pan is on the bottom of the configuration.

For stability, braces 76 may be attached with screws, bolts, and/or glue to tabs 77 of the pans 30, 40; or the braces may be connected directly to the pan walls. Such braces may also be positioned for attachment to the coil 12 with appropriate fasteners.

Figure 10A:
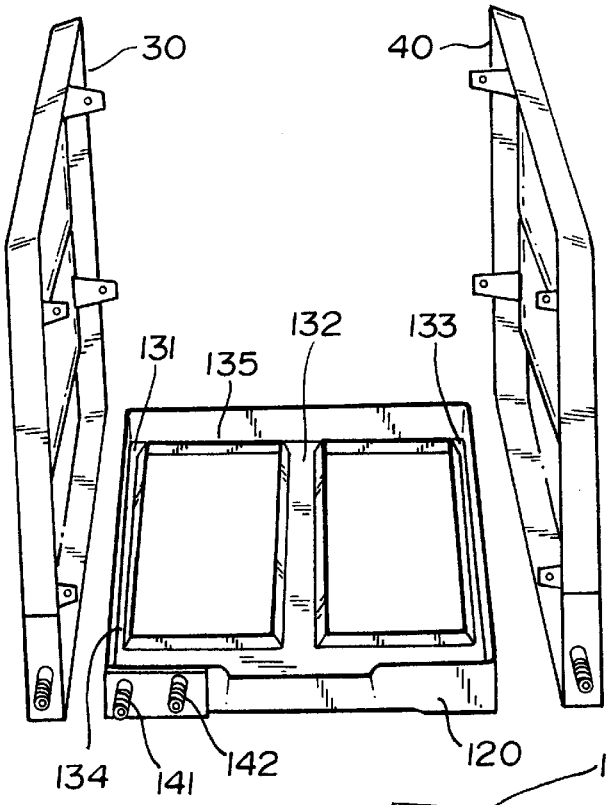
FIG. 10A is a perspective exploded view of a pan according to the present invention.

FIG. 10A shows a pan 100 according to the present invention with side pans 30, 40 (as in the system 10, FIG. 1) and a bottom pan 120 according to the present invention. The pans 30, 40, 120 are fit and/or connected together like the pans 30, 40, 50 of the system 10, FIG. 1. The bottom pan 120 has side walls 121, 122, 123, 124, and inner walls 125, 126, 127, and 128. Bottom walls 131, 132, 133 are, preferably, at a level above that of grooves 134, 135, 136, 137, 138, 139. These grooves are at the level of an end trough 150 which is in fluid communication with two drain outlets 141, 142. The pan 120 is suitable for mounting thereon an M-coil, e.g. as shown in, but not limited to, U.S. Pat. Nos. 5,284,027 and 5,207,074.

The coil 12 may be screwed or bolted to the bottom pan 50 or may rest on it unsecured.

Figure 10B:
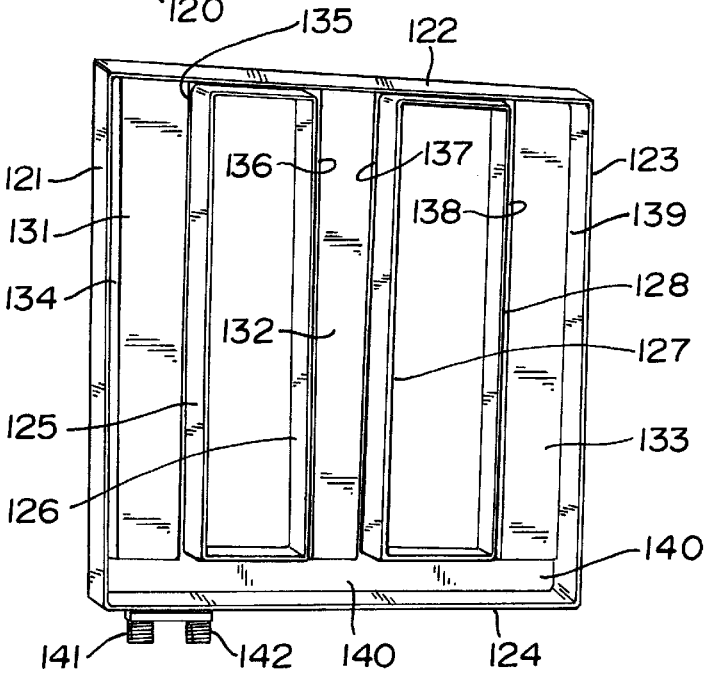
FIG. 10B is a top perspective view of the bottom pan of the system of FIG. 10A.

FIG. 10B shows the pan 120. The pan 120 may include any of the features [e.g. but not limited to groove(s) and/or brace(s)] disclosed for any other pan herein.

The present invention, therefore, provides in certain, but not necessarily all, embodiments, a multi-pan for an air conditioning system having a coil positionable in one of three orientations, the multi-pan having a bottom pan having walls defining an inner space the bottom pan disposed for receiving water from the coil when the coil is positioned above the bottom pan, a first side pan connected at one end to the bottom pan, the first side pan disposed for receiving water from the coil when the coil is positioned above the first side pan, and a second side pan connected at one end to the bottom pan and spaced apart from the first side pan by the bottom pan, the second side pan disposed for receiving water from the coil when the coil is positioned above the second side pan. Such a multi-pan with one, some, or all of the following: the bottom pan having a first sub-pan and a second sub-pan spaced apart from the first sub-pan; the bottom pan wherein the spaced apart sub-pans defining therebetween a fluid flow space; the bottom pan having a bottom pan end trough with an inner surface, the bottom pan end trough in fluid communication with the sub-pans and having a drain hole for draining fluid from the bottom pan end trough; wherein the first side pan is substantially parallel to the bottom pan and each side pan is substantially at a right angle to the bottom pan; the first side pan having a first end trough with an inner surface at first level and a drain hole for draining fluid from the first end trough, and the second side pan having a second end trough with an inner surface at second level and a drain hole for draining fluid from the second end trough, and, in one aspect, each side pan having a side pan groove therein for facilitating fluid flow to its corresponding end trough; wherein the side pan groove extends around substantially three sides of each side pan, the side pan groove comprising two spaced apart side grooves and an end groove, the end groove spaced apart from the end trough by the side grooves and the side grooves spaced apart by the end groove; wherein the side grooves, the end groove, and the end trough define therebetween an inner pan surface at a level higher than a bottom portion of the side grooves, a bottom portion of the end groove, and the inner surface of the end trough; with an air conditioning coil disposed on one of the bottom pan, first side pan, and second side pan; with at least one brace connected between a side pan and the air conditioning coil; wherein the bottom pan and side pans are made of plastic or metal; with at least one brace between and connected to the side pans; wherein each side pan has at least one tab projecting therefrom and the at least one brace has a first end connected to the at least one tab on the first side pan and a second end connected to the at least one tab on the second side pan; and/or wherein the at least one tab is a plurality of tabs on each side pan and the at least one brace is a plurality of braces, each brace interconnected between a tab on the first side pan and a tab on the second side pan.

The present invention, therefore, provides in certain, but not necessarily all, embodiments, a multi-pan for an air conditioning system having a coil positionable in one of three orientations, the multi-pan comprising a bottom pan having walls defining an inner space the bottom pan disposed for receiving water from the coil when the coil is positioned above the bottom pan, a first side pan connected at one end to the bottom pan, the first side pan disposed for receiving water from the coil when the coil is positioned above the first side pan, and a second side pan connected at one end to the bottom pan and spaced apart from the first side pan by the bottom pan, the second side pan disposed for receiving water from the coil when the coil is positioned above the second side pan, the bottom pan having a first sub-pan and a second sub-pan spaced apart from the first sub-pan, the spaced apart sub-pans defining therebetween a fluid flow space, the bottom pan having a bottom pan end trough with an inner surface, the bottom pan end trough in fluid communication with the sub-pans and having a drain hole for draining fluid from the bottom pan end trough, the first side pan having a first end trough with an inner surface at first level and a drain hole for draining fluid from the first end trough, and the second side pan having a second end trough with an inner surface at second level and a drain hole for draining fluid from the second end trough. Such a multi-pan with: each side pan having a side pan groove therein for facilitating fluid flow to its corresponding end trough, wherein the side pan groove extends around substantially three sides of each side pan, the side pan groove comprising two spaced apart side grooves and an end groove, the end groove spaced apart from the end trough by the side grooves and the side grooves spaced apart by the end groove, wherein the side grooves, the end groove, and the end trough define therebetween an inner pan surface at a level higher than a bottom portion of the side grooves, a bottom portion of the end groove, and the inner surface of the end trough; with an air conditioning coil disposed on one of the bottom pan, first side pan, and second side pan; with at least one brace between and connected to the side pans; and/or with at least one brace connected between a side pan and the air conditioning coil. Any pan herein may be used with any suitable coil, including, but not limited to, A-coils, V-coils, and/or M-coils.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The invention claimed herein is not obvious in accordance with 35 U.S.C. §103 and satisfies the conditions for patentability in §103. This specification and the claims that follow are in accordance with all of the requirements of 35 U.S.C. §112. The inventor may rely on the Doctrine of Equivalents to determine and assess the scope of the invention and of the claims that follow as they may pertain to apparatus not materially departing from, but outside of, the literal scope of the invention as set forth in the following claims.

What is claimed is:

1. A multi-pan for an air conditioning system having a coil positionable in one of three orientations, the multi-pan comprising a bottom pan having walls defining an inner space the bottom pan disposed for receiving water from the coil when the coil is positioned above the bottom pan, a first side pan connected at one end to the bottom pan, the first side pan disposed for receiving water from the coil when the coil is positioned above the first side pan, a second side pan connected at one end to the bottom pan and spaced apart from the first side pan by the bottom pan, the second side pan disposed for receiving water from the coil when the coil is positioned above the second side pan, and wherein the first side pan is parallel to the bottom pan and each side pan is at a right angle to the bottom pan.

2. A multi-pan for an air conditioning system having a coil positionable in one of three orientations, the multi-pan comprising a bottom pan having walls defining an inner space the bottom pan disposed for receiving water from the coil when the coil is positioned above the bottom pan, a first side pan connected at one end to the bottom pan, the first side pan disposed for receiving water from the coil when the coil is positioned above the first side pan, a second side pan connected at one end to the bottom pan and spaced apart from the first side pan by the bottom pan, the second side pan disposed for receiving water from the coil when the coil is positioned above the second side pan, the first side pan having a first end trough with an inner surface at first level and a drain hole for draining fluid from the first end trough, and the second side pan having a second end trough with an inner surface at second level and a drain hole for draining fluid from the second end trough, each side pan having a side pan groove therein for facilitating fluid flow to its corresponding end trough, and wherein the side pan groove extends around three sides of each side pan, the side pan groove comprising two spaced apart side grooves and an end groove, the end groove spaced apart from the end trough by the side grooves and the side grooves spaced apart by the end groove.

3. The multi-pan of claim 2 wherein the side grooves, the end groove, and the end trough define therebetween an inner pan surface at a level higher than a bottom portion of the side grooves, a bottom portion of the end groove, and the inner surface of the end trough.

4. A multi-pan for an air conditioning system having a coil positionable in one of three orientations, the multi-pan comprising a bottom pan having walls defining an inner space the bottom pan disposed for receiving water from the coil when the coil is positioned above the bottom pan, a first side pan connected at one end to the bottom pan, the first side pan disposed for receiving water from the coil when the coil is positioned above the first side pan, and a second side pan connected at one end to the bottom pan and spaced apart from the first side pan by the bottom pan, the second side pan disposed for receiving water from the coil when the coil is positioned above the second side pan, the bottom pan having a first sub-pan and a second sub-pan spaced apart from the first sub-pan, the spaced apart sub-pans defining therebetween a fluid flow space, the bottom pan having a bottom pan end trough with an inner surface, the bottom pan end trough in fluid communication with the sub-pans and having a drain hole for draining fluid from the bottom pan end trough, the first side pan having a first end trough with an inner surface at first level and a drain hole for draining fluid from the first end trough, the second side pan having a second end trough with an inner surface at second level and a drain hole for draining fluid from the second end trough, each side pan having a side pan groove therein for facilitating fluid flow to its corresponding end trough, wherein the side pan groove extends around three sides of each side pan, the side pan groove comprising two spaced apart side grooves and an end groove, the end groove spaced apart from the end trough by the side grooves and the side grooves spaced apart by the end groove, and wherein the side grooves, the end groove, and the end trough define therebetween an inner pan surface at a level higher than a bottom portion of the side grooves, a bottom portion of the end groove, and the inner surface of the end trough.

5. A multi-pan for an air conditioning system having a coil positionable in one of three orientations, the multi-pan comprising a bottom pan having walls defining an inner space the bottom pan disposed for receiving water from the coil when the coil is positioned above the bottom pan, a first side pan connected at one end to the bottom pan, the first side pan disposed for receiving water from the coil when the coil is positioned above the first side pan, and a second side pan connected at one end to the bottom pan and spaced apart from the first side pan by the bottom pan, the second side pan disposed for receiving water from the coil when the coil is positioned above the second side pan.

6. The multi-pan of claim 5, the bottom pan further comprising a first sub-pan and a second sub-pan spaced apart from the first sub-pan.

7. The multi-pan of claim 6, the bottom pan further comprising the spaced apart sub-pans defining therebetween a fluid flow space.

8. The multi-pan of claim 6 an further comprising the bottom pan having a bottom pan end trough with an inner surface, the bottom pan end trough in fluid communication with the sub-pans and having a drain hole for draining fluid from the bottom pan end trough.

9. The multi-pan of claim 5 wherein the first side pan is parallel to the bottom pan and each side pan is at a right angle to the bottom pan.

10. The multi-pan of claim 5 further comprising the first side pan having a first end trough with an inner surface at first level and a drain hole for draining fluid from the first end trough, and the second side pan having a second end trough with an inner surface at second level and a drain hole for draining fluid from the second end trough.

11. The multi-pan of claim 10 further comprising each side pan having a side pan groove therein for facilitating fluid flow to its corresponding end trough.

12. The multi-pan of claim 11 wherein the side pan groove extends around three sides of each side pan, the side pan groove comprising two spaced apart side grooves and an end groove, the end groove spaced apart from the end trough by the side grooves and the side grooves spaced apart by the end groove.

13. The multi-pan of claim 12 wherein the side grooves, the end groove, and the end trough define therebetween an inner pan surface at a level higher than a bottom portion of the side grooves, a bottom portion of the end groove, and the inner surface of the end trough.

14. The multi-pan of claim 5 further comprising an air conditioning coil disposed on one of the bottom pan, first side pan, and second side pan.

15. The multi-pan of claim 14 further comprising at least one brace connected between a side pan and the air conditioning coil.

16. The multi-pan of claim 5 wherein the bottom pan and side pans are made of plastic.

17. The multi-pan of claim 5 further comprising at least one brace between and connected to the side pans.

18. The multi-pan of claim 17 wherein each side pan has at least one tab projecting therefrom and the at least one brace has a first end connected to the at least one tab on the first side pan and a second end connected to the at least one tab on the second side pan.

19. The multi-pan of claim 18 wherein the at least one tab is a plurality of tabs on each side pan and the at least one brace is a plurality of braces, each brace interconnected between a tab on the first side pan and a tab on the second side pan.

20. A multi-pan for an air conditioning system having a coil positionable in one of three orientations, the multi-pan comprising a bottom pan having walls defining an inner space the bottom pan disposed for receiving water from the coil when the coil is positioned above the bottom pan, a first side pan connected at one end to the bottom pan, the first side pan disposed for receiving water from the coil when the coil is positioned above the first side pan, and a second side pan connected at one end to the bottom pan and spaced apart from the first side pan by the bottom pan, the second side pan disposed for receiving water from the coil when the coil is positioned above the second side pan, the bottom pan having a first sub-pan and a second sub-pan spaced apart from the first sub-pan, the spaced apart sub-pans defining therebetween a fluid flow space, the bottom pan having a bottom pan end trough with an inner surface, the bottom pan end trough in fluid communication with the sub-pans and having a drain hole for draining fluid from the bottom pan end trough, the first side pan having a first end trough with an inner surface at first level and a drain hole for draining fluid from the first end trough, and the second side pan having a second end trough with an inner surface at second level and a drain hole for draining fluid from the second end trough.

21. The multi-pan of claim 20 further comprising each side pan having a side pan groove therein for facilitating fluid flow to its corresponding end trough, wherein the side pan groove extends around three sides of each side pan, the side pan groove comprising two spaced apart side grooves and an end groove, the end groove spaced apart from the end trough by the side grooves and the side grooves spaced apart by the end groove, wherein the side grooves, the end groove, and the end trough define therebetween an inner pan surface at a level higher than a bottom portion of the side grooves, a bottom portion of the end groove, and the inner surface of the end trough.

22. The multi-pan of claim 20 further comprising an air conditioning coil disposed on one of the bottom pan, first side pan, and second side pan.

23. The multi-pan of claim 22 further comprising at least one brace connected between a side pan and the air conditioning coil.

24. The multi-pan of claim 20 further comprising at least one brace between and connected to the side pans.

* * * * *